US010021934B2

(12) United States Patent
Law

(10) Patent No.: US 10,021,934 B2
(45) Date of Patent: Jul. 17, 2018

(54) FOOTWEAR OUTSOLE WITH FABRIC AND A METHOD OF MANUFACTURING THEREOF

(75) Inventor: Yuen Mou Law, Tsuen Wan (HK)

(73) Assignee: MAGIC LAND LIMITED, Hong Kong (HK)

( * ) Notice: Subject to any disclaimer, the term of this patent is extended or adjusted under 35 U.S.C. 154(b) by 333 days.

(21) Appl. No.: 12/685,876

(22) Filed: Jan. 12, 2010

(65) Prior Publication Data

US 2011/0167680 A1 Jul. 14, 2011

(51) Int. Cl.

| | |
|---|---|
| ***A43B 13/12*** | (2006.01) |
| ***A43B 13/34*** | (2006.01) |
| ***A43C 13/00*** | (2006.01) |
| ***A43B 9/06*** | (2006.01) |
| ***A43B 3/10*** | (2006.01) |
| ***A43B 13/04*** | (2006.01) |

(52) U.S. Cl.

CPC ..... *A43B 3/108* (2013.01); *A43B 3/107* (2013.01); *A43B 13/04* (2013.01); *A43B 13/12* (2013.01); *Y10T 156/10* (2015.01); *Y10T 442/647* (2015.04)

(58) Field of Classification Search

CPC ..... A43B 3/04; A43B 3/07–3/08; A43B 13/12
USPC ..... 36/9 R, 103, 30 R, 25 R, 59 R, 44, 15, 36/17 R, 19.5, 22 R; 12/146 B, 142 G, 12/142 F

See application file for complete search history.

(56) References Cited

U.S. PATENT DOCUMENTS

| | | | | |
|---|---|---|---|---|
| 2,371,689 | A * | 3/1945 | Gregg et al. | 36/30 R |
| 2,391,564 | A * | 12/1945 | Gregg | 36/30 R |
| 3,352,032 | A * | 11/1967 | Yamaguchi | 36/9 R |
| 3,863,272 | A * | 2/1975 | Guille | 2/239 |
| 4,649,586 | A * | 3/1987 | Wu | 12/146 B |
| 6,237,249 | B1 * | 5/2001 | Aguerre | 36/11.5 |
| 6,698,109 | B2 * | 3/2004 | Otis et al. | 36/59 R |
| 6,782,642 | B2 * | 8/2004 | Knoche et al. | 36/129 |
| 6,944,975 | B2 * | 9/2005 | Safdeye et al. | 36/59 R |
| 7,036,246 | B2 * | 5/2006 | Otis et al. | 36/59 R |

* cited by examiner

*Primary Examiner* — Timothy K Trieu

(57) ABSTRACT

The sole of a footwear such as slipper having an outsole. The sole is made of a foam material and outsole area of which is partly laid with a fabric material. The fabric is attached to the outsole layer by a plastic which has been heat pressed to the fabric and the foam material. This provides a strong attachment between the fabric-plastic-foam material.

3 Claims, 4 Drawing Sheets

FOOTWEAR OUTSOLE WITH FABRIC AND A METHOD OF MANUFACTURING THEREOF

FIELD OF INVENTION

This invention pertains to footwear. In particular, this invention relates to the sole of footwear

BACKGROUND OF THE INVENTION

Currently, the sole of a footwear such as a slipper sometimes has a section laid with fabric. Typically, the fabric is attached to the outsole surface of the sole by glue or adhesive.

EVA (Ethylene Vinyl Acetate) is a material commonly used to make the sole of such footwear. Sometimes, the EVA is combined with other materials such as rubber, polyethylene, POE, etc., with EVA being the major content.

However, the fabric easily peels off as the sole is used worn and used, as the adhesive gives way to wear and tear.

Thus, it is desirable to provide a method which could better secure the fabric to the outsole surface of the sole.

SUMMARY OF THE INVENTION

In a first aspect, the invention proposes a footwear sole comprising a foam material providing an outsole and an insole, a layer of fabric on the outsole surface of the form material, the layer of fabric adhered to the foam material by a molten plastic layer.

In a second aspect, the invention proposes a method of providing a sole having a fabric layer comprising the steps of providing a foam material, the foam material having a surface forming an outsole and an opposite surface forming an insole, providing a layer of fabric, providing a layer of plastic between the fabric and the foam material, heat pressing the layers of fabric, plastic and foam material, such that the layers of fabric and foam material is adhered by the plastic.

Preferably, the foam material comprises EVA.

Preferably, the plastic is a thermoplastic material, such as polypropylene. Therefore, the plastic melts under heat and the molten plastic flows over the surface of the foam material and efficiently contacts the foam material. Furthermore, the heat expands any air between the foam material and dispels some of the air from between the layers of fabric-plastic-foam material.

Furthermore, the pressure helps to increase and improve the contact between the fabric an plastic, or plastic and foam material. The pressure also dispels air between the fabric and plastic, or plastic and foam material. Thus, the entire area of molten plastic is placed in contact with the corresponding area of foam material, and the corresponding area of fabric. On cooling, the thermoplastic solidifies and adheres the layers of fabric, plastic and foam material together.

Alternatively, the plastic is a thermoset material which can be heat cured to bind to the fabric and to the foam material. In this case, the heat both cures and dispels air and gas from the between the layers of fabric-plastic-foam material. The pressure also helps to dispel air and gas from between the layers.

BRIEF DESCRIPTION OF THE FIGURES

It will be convenient to further describe the present invention with respect to the accompanying drawings that illustrate possible arrangements of the invention, in which like integers refer to like parts. Other arrangements of the invention are possible, and consequently the particularity of the accompanying drawings is not to be understood as superseding the generality of the preceding description of the invention.

DETAILED DESCRIPTION OF THE INVENTION

Figure 1:
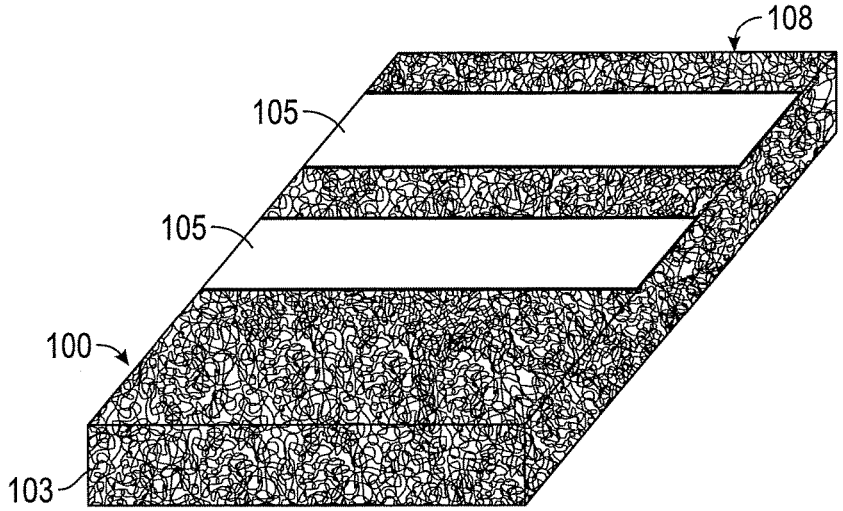
FIG. 1 shows the foam material used in an embodiment of the invention.

FIG. 1 shows an embodiment 100 of the invention, comprising piece of foam material 103 with appropriate hardness to be cut into the size and shape of the sole of footwear. The white parts/defined portions 105 are the locations in which fabrics are to be attached, which is on the outsole surface 108 of the sole.

Typically, the foam material 103 can be made of EVA, or other suitable sole material. Such foam material 103 tends to have multiple small air pockets (not illustrated) trapped in a resilient material, thereby providing a cushioning effect required for a footwear sole.

Figure 2:
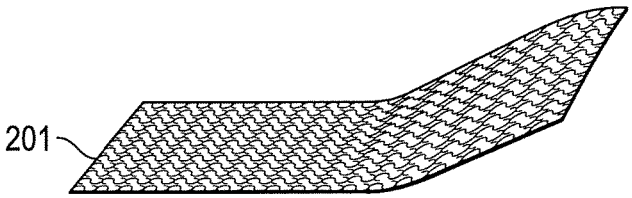
FIG. 2 shows the fabric used in an embodiment in FIG. 1.

FIG. 2 shows a piece of fabric 201 cut to size and shaped to the white/defined portions 105 of the sole. Although not necessarily, the fabric 201 is preferably a fabric material which is nonwoven to prevent loose threads from breaking free of the fabric 201.

Figure 3:
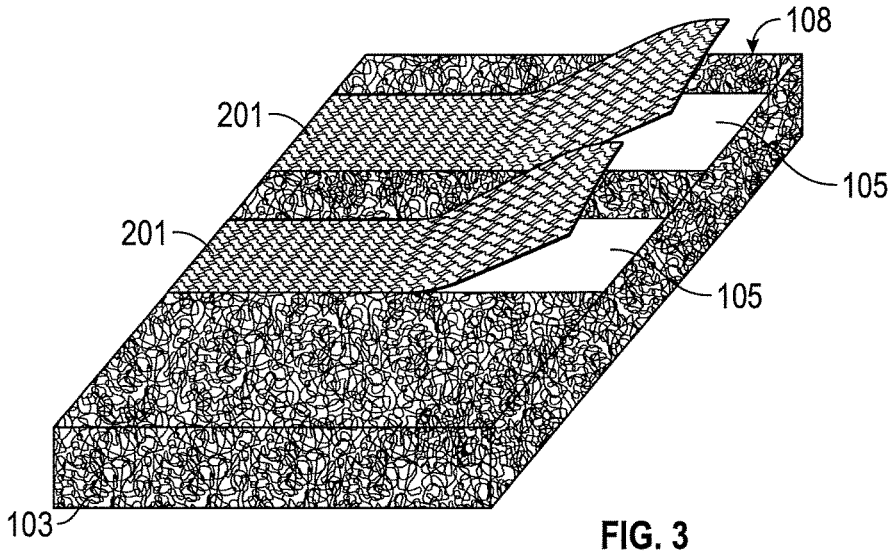
FIG. 3 shows a step of adhering the fabric to the foam material of the embodiment in FIG. 1.
Figure 7:
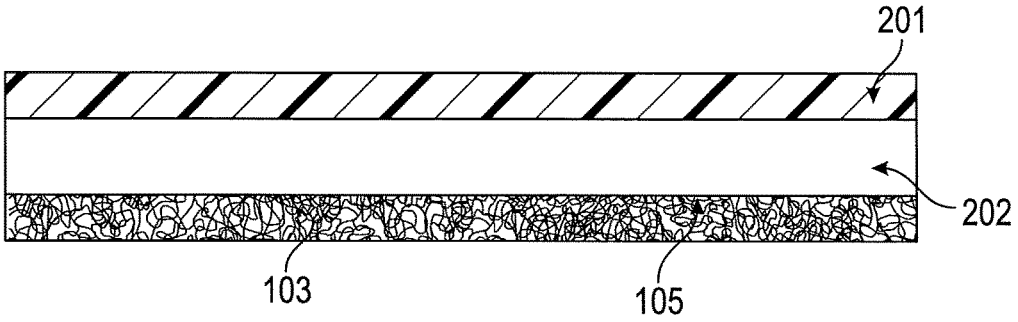
FIG. 7 shows a side cross-sectional view of a fabric-plastic layer in direct contact with defined portions on the outsole surface of the foam material shown in FIG. 1.

A piece of plastic sheet 202 is attached to the fabric 201 material by adhesive, so that the fabric 201 and the plastic 202 are pre-attached to each other. See, e.g., FIG. 7. Subsequently, the plastic-attached fabric 201 is laid and positioned onto the outsole surface 108 of the foam material 103. This is shown in FIG. 3, where the fabric 201 is laid onto the white parts/defined portions 105 of the foam material 103, such that the side of the fabric 201 with plastic sheet 202 is in contact with EVA.

Figure 4:
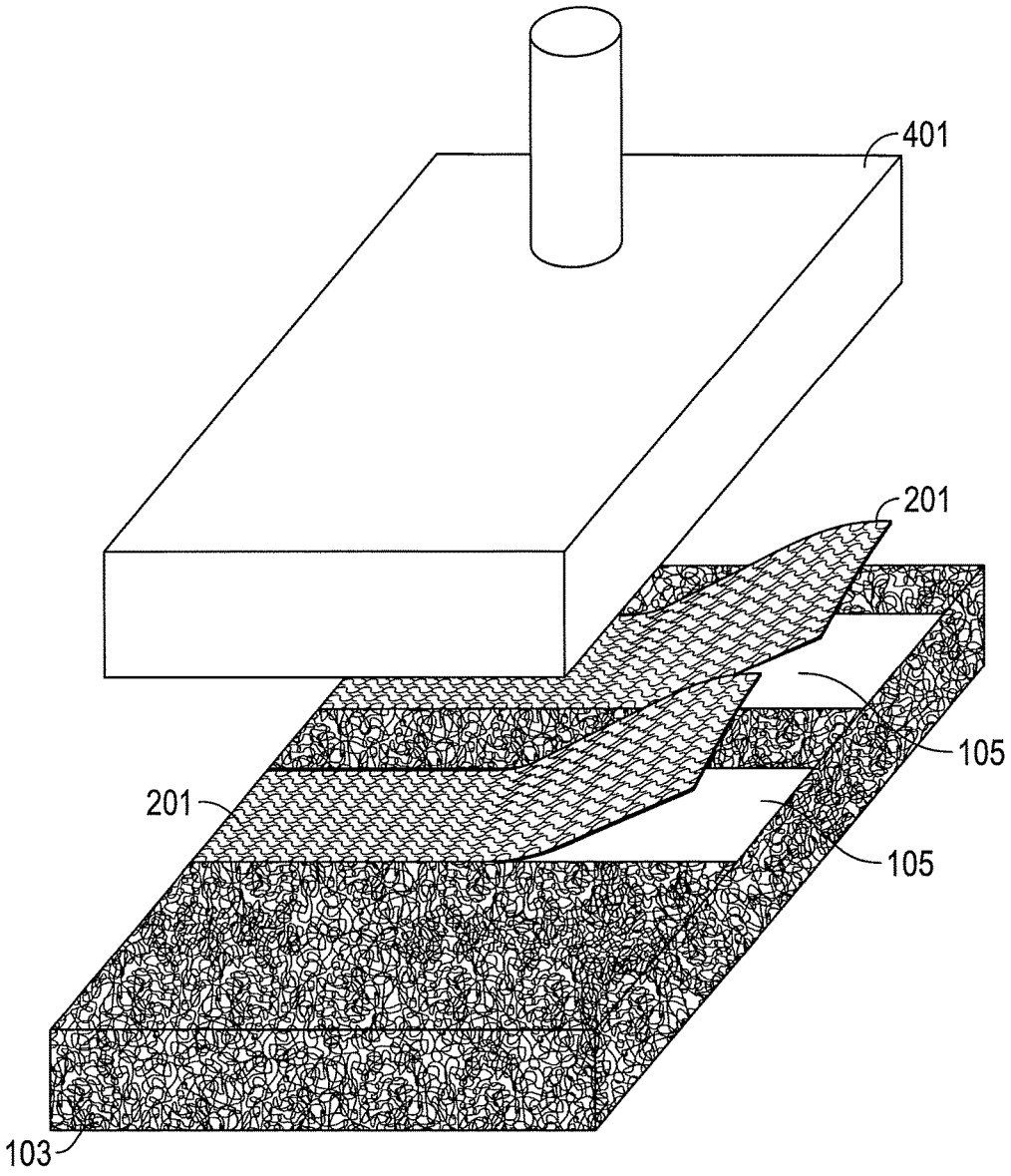
FIG. 4 shows a step of heat pressing the fabric to the foam material of the embodiment in FIG. 1.

FIG. 4 shows the layer of fabric 201, plastic sheet 202 and foam material 103 heat-pressed to attach the fabric 201 to the foam material 103. The plastic 202 serves as a strong adhesive between the foam material 103 and the fabric 201.

The plastic sheet 202 is cut to the size and shape of fabric 201, and attached to fabric 201 with glue before the fabric 201 is laid onto the sole. See, e.g., FIG. 7. After the fabric 201 is laid onto the outsole surface 108, the heat pressing machine 401 heat pressed onto the layers of fabric 201, plastic 202, and foam material 103.

In this embodiment 100, the plastic sheet 202 is polypropylene. Thus, the plastic 202 is thermoplastic and melts under heat. The molten plastic 202 flows over the surface of the foam material 103 and efficiently contacts the foam material 103. That is, the heat expands any air between the foam material 103, and the heat and pressure on the molten plastic 202 dispels the air. Thus, the entire area of molten plastic 202 is placed in contact with the corresponding area of foam material 103. By way of molecular affinity, which is a well-known scientific principle, the plastic 202 has a cohesive affinity to the foam material 103, which is also a polymer.

In the same way, the heart causes the molten plastic 202 to adhere to the fabric 201, by increasing the surface contact between the fabric 201 and the plastic 202, and dispelling air between the fabric 201 and plastic 202.

Subsequently, when the heating is removed, the plastic 202 solidifies while remaining in contact with both the foam material 103 and the fabric 201. This forms a strong adhesive contact between the fabric 201 to the plastic 202, and between the plastic 202 to the foam material 103.

Optionally, the heating is stopped while the pressure on the fabric 201-plastic 202-foam material 103 layers is maintained, to allow the plastic 202 to solidify under pressure.

Figure 5:
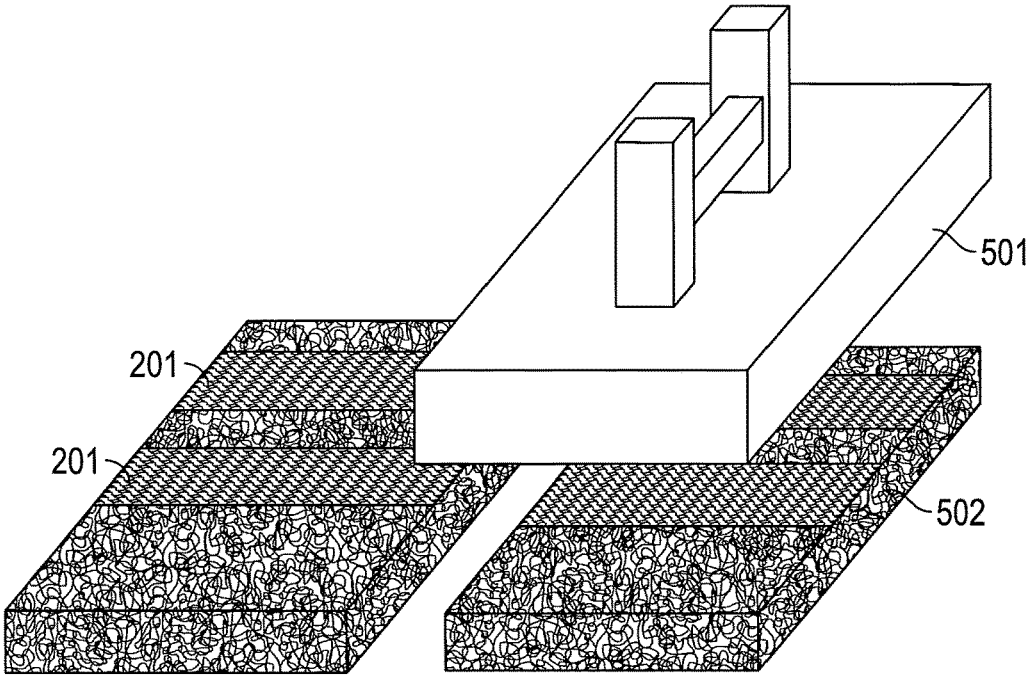
FIG. 5 shows a step of cold pressing the outsole surface of embodiment in FIG. 1.

FIG. 5 shows that, subsequently, the combined layers are subjected to cold-pressing, using a cold-press machine 501. The cold pressure further maintains the contact between the fabric 201-plastic 202-foam material 103 layers, and hastens the cooling and solidification of the plastic 202. FIG. 5 shows a plurality individual of the fabric-plastic layer disposed on the outsole.

Optionally, the surface of the cold-press is a mould which can impart a pattern 502 to the outsole surface, which is by this time partly fabric 201 and partly foam material 103. By 'pattern' 502, this means that a physical texture is imparted to the surface of the outsole 108. The pattern 502 on the outsole 108 is useful for slip-resistance.

Figure 6:
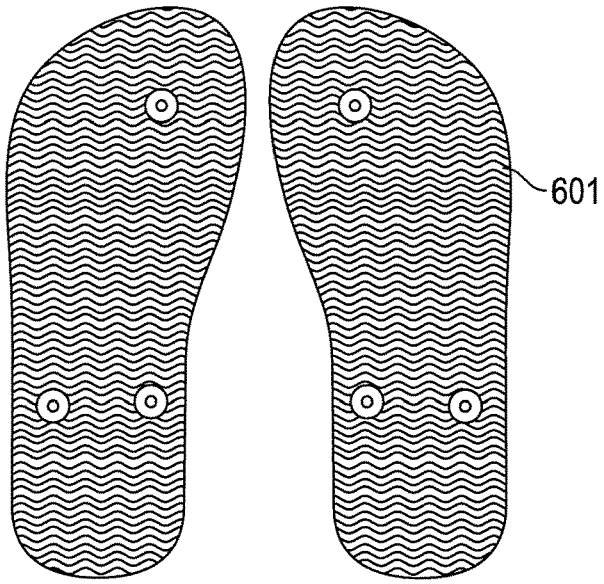
FIG. 6 shows the completed embodiment of FIG. 1.

Subsequently, the fabric 201-plastic 202-foam material 103 is cut and trimmed into the shape of a sole 601, see FIG. 6, to be used as part of a footwear, such as a pair of slippers.

Therefore, the embodiment 100 is a footwear sole 601 comprising a foam material 103 providing an outsole 108 and an insole, a layer of fabric 201 on the outsole 108 surface of the foam material 103, the layer of fabric 201 adhered to the foam material 103 by a molten plastic layer 202.

Therefore, the embodiment 100 includes method of providing a sole 601 having a fabric 201 layer comprising the steps of providing a foam material 103, the foam material 103 having a surface forming an outsole 108 and an opposite surface forming an insole, providing a layer of fabric 201, providing a layer of plastic 202 between the fabric 201 and the foam material 103, heat pressing the layers of fabric 201, plastic 202, and foam material 103, such that the layers of fabric 201 and foam material 103 is adhered by the plastic 202.

While there has been described in the foregoing description preferred embodiment 100*s* of the present invention, it will be understood by those skilled in the technology concerned that many variations or modifications in details of design, construction or operation may be made without departing from the scope of the present invention as claimed.

For example, the skilled man knows that the plastic sheet 202 is not limited to polypropylene. The choice of a suitable thermoplastic mainly depends on compositions and materials of making up the foam material 103 of the sole 601, and the fabric 201.

Furthermore, while thermoplastic is mentioned in the embodiment 100, it is possible to use a thermoset material as the plastic layer 202 between the fabric 201 and the foam material 103, which can be cured in placed during the heat pressing.

The heat pressing can be done using machine or manually with a heat element, such as an iron.

By cold pressing, the 'cold' can include room temperature or any temperature lower than the heat pressing temperature, as long as the thermoplastic is allowed to solidify. Thus, the temperature used depends on the material of the fabric 201, plastic 202, and foam material 103. Similarly, the temperature of the heat pressing depends on the material of the fabric 201, plastic 202, and foam material 103, and should not breakdown or burn any of these layers.

The invention claimed is:

1. Footwear comprising a footwear sole, said footwear sole comprising:

a foam material having an outsole and an insole; said outsole having a defined portion, and the foam material is ethylene vinyl acetate ("EVA"); and a fabric-plastic layer, comprising a layer of fabric pre-attached to a layer of plastic; the layer of fabric is a layer of non-woven material, which prevents loose threads from breaking free of the fabric, and the layer of plastic is thermoplastic and melts under heat;

wherein the layer of plastic is in direct contact with and attached to only the defined portion of the outsole of the foam material;

wherein two sides of the layer of plastic is in adhesive contact with the layer of fabric and the foam material respectively after being heat pressed; and the layer of plastic is in adhesive contact with the EVA of the foam material;

wherein a surface area of one side of the layer of plastic is placed in adhesive contact with the foam material; wherein a plurality individual of the fabric-plastic layer disposed on the outsole;

providing the foam material, the foam material having one surface forming the outsole and the other surface forming the insole; providing the layer of fabric; providing the layer of plastic between the layer of fabric and the foam material; heat pressing the layer of fabric, the layer of plastic and the foam material; the plastic in the layer of plastic being thermoplastic and melting under the heat, and the molten plastic flowing over the surface of the foam material; after removing the heat pressing, the molten plastic solidifying while remaining in contact with the layer of fabric and the foam material; the layer of fabric, the layer of plastic and the foam material being subject to cold pressing and pressure via using a cold pressing machine, further solidifying the adhesive contact between the layer of plastic and the layer of fabric, and between the layer of plastic and the foam material respectively.

2. Footwear as claim in claim 1, wherein the footwear is a slipper.

3. Footwear as claimed in claim 1, wherein the plastic layer comprises polypropylene.

* * * * *